US008500486B2

(12) United States Patent
Buck et al.

(10) Patent No.: US 8,500,486 B2
(45) Date of Patent: Aug. 6, 2013

(54) ELECTRICAL PLUG CONNECTOR

(75) Inventors: Carsten Buck, Heppenheim (DE); Rolf Jetter, Darmstadt (DE); Torsten Sieler, Darmstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/734,481

(22) PCT Filed: Oct. 29, 2008

(86) PCT No.: PCT/EP2008/064681

§ 371 (c)(1), (2), (4) Date: May 4, 2010

(87) PCT Pub. No.: WO2009/059921

PCT Pub. Date: May 14, 2009

(65) Prior Publication Data

US 2011/0177715 A1 Jul. 21, 2011

(30) Foreign Application Priority Data

Nov. 5, 2007 (DE) ..... 10 2007 052 606

(51) Int. Cl.
*H01R 13/73* (2006.01)

(52) U.S. Cl.
USPC ..... 439/551

(58) Field of Classification Search
USPC ..... 439/550, 607.28, 551, 544, 314, 439/316, 318; 285/396, 401, 402; 411/49, 411/89, 166, 315, 321, 350, 345; 200/296
See application file for complete search history.

(56) References Cited

U.S. PATENT DOCUMENTS

| | | | | |
|---|---|---|---|---|
| 3,721,943 | A * | 3/1973 | Curr | 439/273 |
| 4,183,605 | A * | 1/1980 | Arneson | 439/311 |
| 4,386,814 | A * | 6/1983 | Asick | 439/607.28 |
| 5,108,300 | A | 4/1992 | Weber | |
| 5,145,412 | A * | 9/1992 | Tan et al. | 439/620.03 |
| 6,033,263 | A * | 3/2000 | Weidler et al. | 439/620.1 |
| 6,206,714 | B1 * | 3/2001 | Bernardini | 439/335 |
| 6,824,403 | B2 * | 11/2004 | Hall et al. | 439/108 |
| 7,074,084 | B2 * | 7/2006 | Shuey et al. | 439/607.32 |

(Continued)

FOREIGN PATENT DOCUMENTS

| | | |
|---|---|---|
| EP | 0 446 466 A | 9/1991 |
| EP | 0 939 462 A | 9/1999 |
| FR | 2 702 601 A | 9/1994 |
| GB | 2 294 816 A | 5/1996 |

OTHER PUBLICATIONS

International Search Report for PCT/EP2008/064681 issued by the European Patent Office on Mar. 10, 2009.

*Primary Examiner* — Edwin A. Leon
*Assistant Examiner* — Harshad Patel
(74) *Attorney, Agent, or Firm* — Faegre Baker Daniels LLP

(57) ABSTRACT

The invention relates to an electrical plug connector, in particular to an electrical pin or socket connector, for a data transmission interface in the automotive field, having: a plug connector member (100) and a keyed mounting member (200) which can be mounted on the plug connector member (100) and which ensures correctly oriented insertion of an electrical counter plug connector on the electrical plug connector (1), the plug connector member (100) having a mounting projection (120) such that a wall (2) can be clamped between the mounting projection (120) and the keyed mounting member (200).

11 Claims, 6 Drawing Sheets

U.S. PATENT DOCUMENTS 7,326,063 B1 * 2/2008 Raudenbush et al. ..... 439/63
7,438,596 B2 * 10/2008 Phillips ..... 439/607.01
7,494,374 B2 * 2/2009 Hall et al. ..... 439/564
7,583,510 B2 * 9/2009 Wang ..... 361/753
2003/0114048 A1 6/2003 Hall et al.
2004/0027818 A1 * 2/2004 Rathnam et al. ..... 361/816

* cited by examiner

ELECTRICAL PLUG CONNECTOR

The invention relates to an electrical plug connector, in particular an electrical pin or socket connector, for a data transmission interface in a motor vehicle. Furthermore, the invention relates to a pin contact strip for a data transmission interface, in particular a high-speed data transmission interface, in the automotive field.

Modern motor vehicles have a plurality of electrical and electronic devices, such as, for example, control devices which communicate on a bus or network with an engine control system or a computer for management of the motor vehicle. Data may be carried out digitally in this instance. These devices are associated with functional units of the vehicle, such as, for example, a chassis control system, a drive control system, an entertainment system or a telematics system. The devices of the units in question are in most cases distributed over the entire vehicle. Individual devices communicate with each other and with the engine control system on a data bus, which may be configured differently in accordance with the requirements of the unit. Consequently, the bus lines of the vehicle generally extend over large portions of the vehicle.

In order to ensure communication between the functional units of the vehicle, corresponding connections, such as electrical plug connections are required. In particular, the electromagnetic shielding and electrical pin contact requirements of the plug are increased at high data transmission rates. Such an electrical plug connector, in most cases, is mounted directly on a printed circuit board and electrically contacts the corresponding traces on the board with electromagnetic shielding. It is also secured to a wall, for example, of a control device housing which may contain the printed circuit board.

For instance, in the prior art, a plug connector is secured in an opening of the control device housing wall by a lock nut. By tightening this lock nut, the plug connector is mechanically fixed, on the one hand, and, on the other hand, is secured against the wall by a resilient element to produce a galvanic contact between a shield housing of the plug connector and the wall of the control device housing. A keyed mounting member orients insertion of a mating connector in the electrical plug connector after the plug connector has been mounted on the wall.

Another solution for mounting an electrical plug connector on a wall of a device housing uses a circlip which can be pushed onto the plug connector and which, after the plug connector has been inserted through the mounting hole of the device housing, fixes the plug connector to the device housing. The keyed mounting member for the counter plug connector is subsequently fitted on the plug connector.

U.S. Pat. No. 903,768 discloses a lamp holder which can be rotationally mounted on a wall. A member of the lamp holder is inserted through a mounting hole of the wall and a threaded portion of the holder member that protrudes through the mounting hole is secured to the wall by a threaded ring. In the mounted state, the ring retained on the mounting hole locks rotation of the holder member with mutually corresponding recesses and projections in the securing ring and in the holder member.

EP 939 462 A1 discloses, a lamp holder which has, at an outer periphery of a lamp socket, at least two pins which are connected to the lamp holder using a bayonet connection. The lamp holder comprises a housing and a coding ring connected to each other. An inner embodiment of the coding ring is adapted to an arrangement of the pins of the lamp socket. The coding ring has, on the inner side thereof, correspondingly arranged grooves for the pins of the lamp socket.

EP 1 318 575 A1 discloses an ancillary device casing which can be secured in a wall opening of a mounting wall. For this purpose, an adapter ring is secured to a base member of the ancillary device casing. The adapter ring is inserted through the wall opening in order to mount the ancillary device casing on the mounting wall, such that the base member rests on the mounting wall. A cap nut can be screwed on an outer thread of the adapter that protrudes through the wall opening so that the mounting wall can be secured between the ancillary device casing and the cap nut. Connection of the adapter to the base member may be achieved by a bayonet connection, screw connection or engagement connection.

DE 198 39 342 A1 discloses a plug connector in a wall of an electrical device. A plug connector element of the plug connector can be inserted through an opening from one side of the wall, the plug connector element abutting one side of the wall with a stop flange. From the other side of the wall, a clamping nut can be screwed onto the plug connector element, the device wall being secured between the clamping nut and the stop flange. An outer thread of the plug connector element and a corresponding inner thread of the clamping nut form a bayonet connection, which has three bayonet grooves and corresponding bayonet elements. Between the clamping nut and the plug connector element, there is further formed a releasable lock connection which prevents a rotational movement of the clamping nut relative to the plug connector element.

An object of the invention is to provide an improved electrical plug connector, in particular an improved electrical pin or socket connector, for a data transmission interface in a motor vehicle. Another object of the invention is to provide an improved pin contact strip for a data transmission interface, in particular a high-speed data transmission interface in the automotive field. It is desirable to reduce the number of components of the plug connector as compared to the prior art.

Furthermore, an electrical plug connector according to the invention is intended to mount to a wall in a single assembly operation, and shield the plug connector consistent with EMC provisions. Furthermore, according to the invention, the total number of steps and force for mounting the plug connector in/on the wall are intended to be reduced. Furthermore, it is intended that no additional means for assisting assembly and/or tools should be required in order to mount the plug connector on the wall.

The object of the invention is achieved by means of an electrical plug connector, in particular an electrical pin or socket connector, for a data transmission interface in a motor vehicle according to claim 1, and by means of a pin contact strip for a corresponding data transmission interface, in particular a high-speed data transmission interface, according to claim 12.

The electrical plug connector according to the invention has a plug connector member and a keyed mounting member, mountable in an opening of a wall, for example of a control device. The keyed mounting member, which ensures correctly oriented insertion/fitting of a mating connector in/on the plug connector, can be directly mounted and secured on the plug connector member. In an embodiment of the invention, the plug connector is constructed as a pin contact strip having at least one, but preferably four electrical pin contacts which are preferably retained by a separate contact carrier of the pin contact strip or the plug connector.

According to the invention, it is now no longer necessary to secure the plug connector in/on the wall with a lock nut or a circlip. Instead, the keyed mounting member can be directly mounted on and secured to the plug connector member through the wall. According to the invention, this results in a reduction in the number of components of the electrical plug connector, which in turn results in a reduction in the time required to mount the plug connector on the wall. In particular, by omitting the lock nut, no additional tools or parts are required in order to mount the plug connector.

The plug connector according to the invention can simply be mounted in/on the wall by hand, with only the plug connector member being inserted through a mounting hole of the wall and the keyed mounting member subsequently being mounted or secured on the plug connector member. The keyed mounting member, which is comparatively large with respect to the lock nut allows the plug connector to be readily and rapidly mounted on the wall by hand, resulting in a reduction of the mounting force in comparison with the prior art.

According to the invention, the plug connector member or the contact carrier of the plug connector member has the mounting projection for mounting the electrical plug connector on the wall. The mounting projection may be constructed integrally with the plug connector member or the contact carrier, or may be provided as a separate component on the plug connector member or the contact carrier. Furthermore, the contact carrier may be constructed integrally with the plug connector member. The mounting projection of the plug connector may be provided on the plug connector member or the contact carrier such that the wall on which the plug connector is mounted is clamped or secured between the mounting projection and the keyed mounting member.

According to the invention, a space or gap between the keyed mounting member is constructed to receive the wall in the relevant mounting region. When the plug connector is mounted, the wall is received positively between the mounting projection and the keyed mounting member. In embodiments of the invention, the wall is planar, having a constant thickness, such that the wall, the sides of the keyed mounting member and the mounting projections are mutually parallel. One or more electromagnetic shield contact springs of the plug connector are optionally intended to fit in contact with the wall.

The relevant region of the keyed mounting member is preferably on a rear side of the keyed mounting member, while the relevant side of the mounting projection is the front side of the mounting projection. Preferably, the rear side of the keyed mounting member is formed by a substantially continuous edge, preferably an outer edge, or a projection on the keyed mounting member. Furthermore, it is preferable for the front side of the mounting projection to be formed by spacing members on the mounting projection. These spacing members, with the respective front side thereof, define a plane forming the front side of the mounting projection. When the plug connector mounts in an opening of the wall, the spacing members of the mounting projection and the edge or the projection of the keyed mounting member abut the wall at mutually opposing sides.

In embodiments of the invention, an electrical connection of an electromagnetic shield is formed when the electrical plug connector is mounted on the wall. It is preferred that the wall, in the region of a shield contacting by the plug connector, be an electrically conductive contact with a shield of the electrical device. In embodiments of the invention, the wall is a metal wall or the wall is constructed of metal at least on the side at which the shield of the plug connector electrically connected therewith, further providing an electrical pin contact.

In embodiments of the invention, the mounting projection has one or more contact springs, at the front side thereof, which protrude from the front side of the mounting projection. If spacing members are provided on the mounting projection, the contact springs may protrude further from the front side than the spacing members. When the electrical plug connector is in a mounted in an opening of the wall, only the contact springs abut one side of the wall. Because the plug connector may mount to the wall in a resilient manner, it is possible to mount the same plug connector on walls of different thicknesses or manufacture a plug connector with a relatively high tolerance in the region in which the keyed mounting member is mounted. In other embodiments of the invention, both the contact springs and the spacing members may abut the wall.

In other embodiments of the invention, the contact springs of the electrical plug connector are shield contact springs which produce an electrical connection between the electromagnetic shield of the plug connector and the electromagnetic shield of the wall.

In addition to mechanically fixing the electrical plug connector to the wall in accordance with other embodiments, the electromagnetic shield conforms to EMC provisions. According to the invention, a galvanic contact is formed between the shield housing of the electrical plug connector and a housing of the electrical device, for example the control device.

In other embodiments of the invention, the keyed mounting member is secured to the plug connector member of the electrical plug connector using a screw connection, a plug connection, or a locking connection. Preferably, the keyed mounting member secures to the plug connector member using a bayonet connection, which is formed directly between the keyed mounting member and the plug connector member. A slotted guiding member may be provided on the keyed mounting member and cam followers on the plug connector member, or vice versa. Therefore, there are two possible options on where to provide either the slotted guiding member or the cam followers. If there are a number of slotted guiding members and cam followers, they may also be provided together on one component, as long as the other component has the matching devices.

In embodiments of the invention, the keyed mounting member has, in a side wall, a slotted path, which unites with a cam followers provided on the contact carrier or a mounting portion of the plug connector member. It is preferable to have two slotted paths and two cam followers. However, it is possible to provide more than two slotted paths in the keyed mounting member and cam followers on the contact carrier or the mounting portion.

In order to connect the keyed mounting member with the plug connector member, the keyed mounting member has, at the rear side thereof, a slotted inlet that extends inside the keyed mounting member to the respective slotted guiding member to unite with the cam followers. That is to say, when the keyed mounting member is placed on the contact carrier or the mounting portion, the keyed mounting member is pushed with the slotted inlets over the cam followers until the come to rest at a respective end of the relevant slotted path. Subsequently, the keyed mounting member rotates relative to the plug connector member, whereby the cam followers slid along the slotted path. Thus, the keyed mounting member comes to a final position with respect to the contact carrier of the plug connector member.

In embodiments of the invention, the slotted paths of the keyed mounting member are inclined along a longitudinal axis of the electrical plug connector so that the keyed mounting member may rotate axially in the direction of this longitudinal axis with respect to the plug connector member. As the keyed mounting member rotates, corresponding to the inclination of the slotted path, the wall becomes fixed between the keyed mounting member and the mounting projection. Preferably, each corresponding cam followers are inclined as well.

According to the invention, the keyed mounting member rotates with respect to the plug connector member until the corresponding shoulder engages a locking element. In this instance, the locking element may be constructed in/on the keyed mounting member and the shoulder in/on the contact carrier, or vice-versa, that is to say, the locking element may be constructed in/on the plug connector member and the shoulder that co-operates therewith in the securing position may be constructed in/on the keyed mounting member.

In embodiments of the invention, the locking element on the keyed mounting member is preferably constructed as a curved locking spring, and the plug connector member has a locking ramp that can be brought into engagement with the locking spring. While securing the keyed mounting member on the plug connector member, the locking spring engages on a stop of the locking ramp. Preferably, the locking spring is lifted from the locking ramp during rotation of the keyed mounting member. After having completely passed the locking ramp, the locking spring engages and then blocks a counter-directed relative rotation because of the two mutually opposed stops of the locking spring and locking ramp. The keyed mounting member reaches its securing position on the plug connector member, whereby the plug connector member and the keyed mounting member are secured to each other by means of the bayonet connection, which is formed therebetween.

In order for the locking spring to move beyond the locking ramp, the locking spring has a recess, which corresponds to the locking ramp, and in which the locking ramp, when the keyed mounting member is pushed onto the plug connector member, can be wholly received in the longitudinal direction of the plug connector. That is to say, before the keyed mounting member is rotated relative to the plug connector member, a peripheral portion of the locking ramp is received substantially and completely in the curved recess. When the keyed mounting member rotates relative to the plug connector member, the locking spring is lifted by the locking ramp because the recess decreases in depth in a peripheral direction. After the free end of the locking spring passes the free end of the locking ramp, the locking spring engages with the locking ramp, whereby the keyed mounting member engages on the contact carrier to securely mount a wall between the keyed mounting member and the mounting projection of the plug connector member.

In embodiments of the invention, the keyed mounting member is fixed to the electrical plug connector by a bayonet connection. The slotted path of the bayonet connection is preferably inclined relative to the longitudinal direction of the plug connector. Because of a rotational movement of the keyed mounting member during mount, the keyed mounting member moves in a longitudinal direction towards the mounting projection or in the direction towards the shield contact springs of the plug connector, and a mechanical fixing of the housing in the securing position. The plug connector then mounts on the wall at the same time, and the shield contact springs of the plug connector are pressed against the metal housing, which brings about galvanic contacting in accordance with EMC provisions.

Additional embodiments of the invention will be appreciated from the remaining dependent claims.

The invention is explained in greater detail below with reference to embodiments and the appended drawings, in which.

Figure 1:
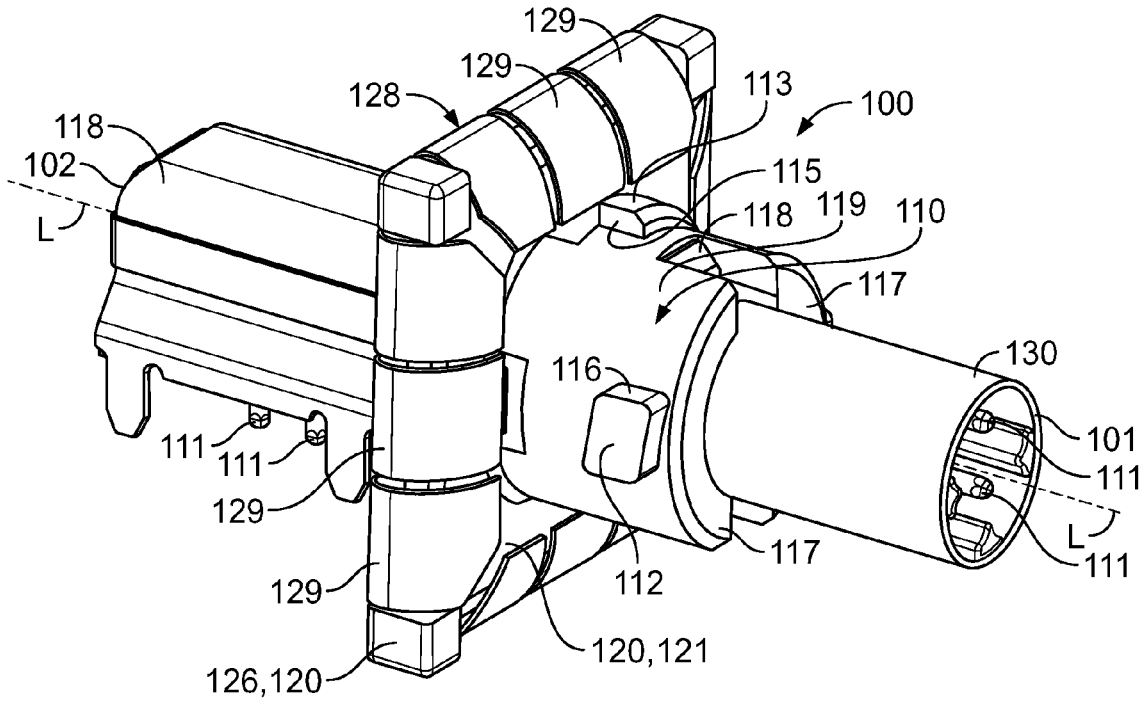
FIG. 1 is a perspective view of a plug connector member for an electrical plug connector in accordance with the invention.

The invention is explained in greater detail below with reference to an electrical connector for a data transmission interface in a motor vehicle. However, the invention is not intended to be limited to electrical connectors, but instead is intended to relate to electrical plug connectors in quite general terms, such as electrical plug connectors or socket connectors. Furthermore, for this specification, the prepositions "at", "in" and "on" are intended to have a synonymous meaning. Furthermore, indications which refer to a front side or a rear side of a portion or (component) part of the electrical plug connector 1 are intended to be oriented with respect to a front side 101 and a rear side 102 of a plug connector member 100 or a front side 201 and a rear side 202 of a keyed mounting member 200 of the electrical plug connector 1.

Figure 6:
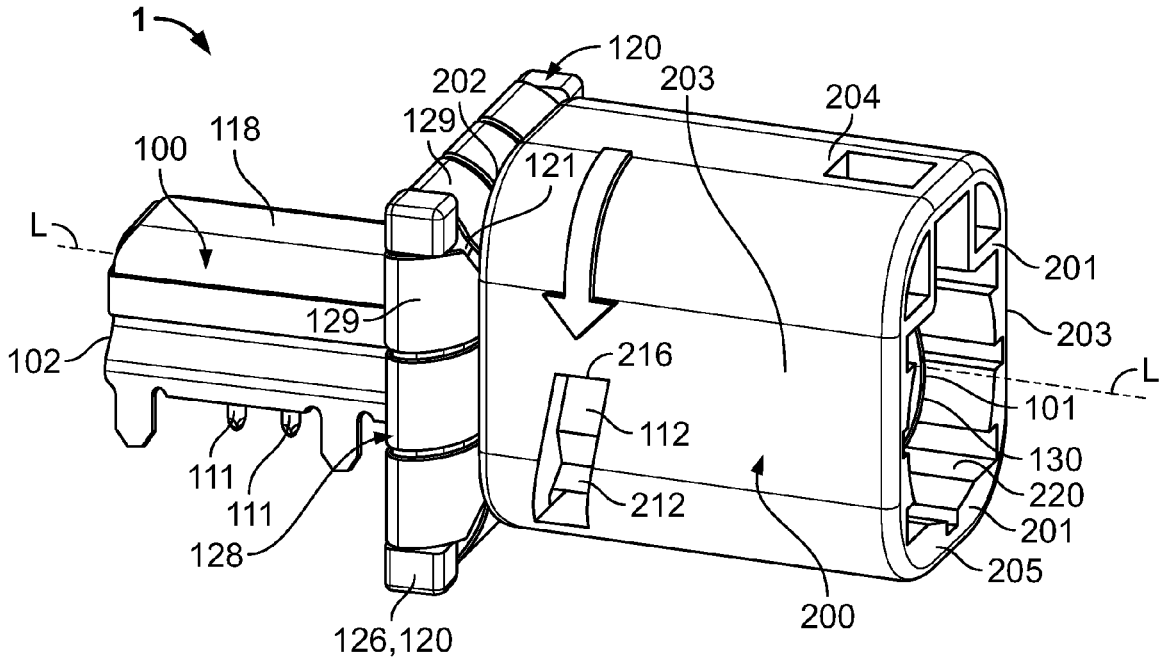
FIG. 6 is a perspective view of the keyed mounting member in the securing position on the plug connector member.
Figure 10:
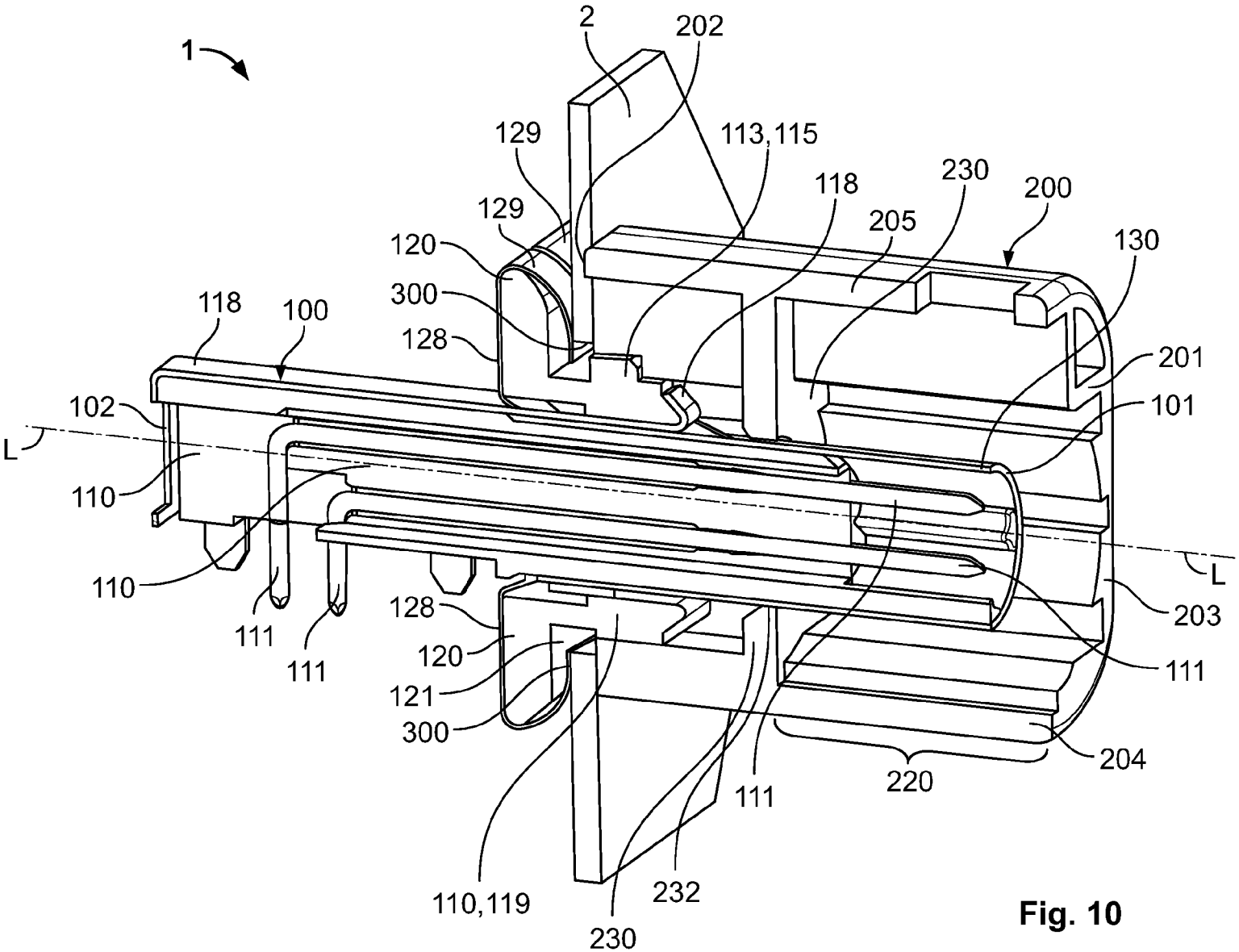
FIG. 10 is a sectioned perspective view taken along a longitudinal axis of the electrical plug connector while mounted on a wall.

FIG. 1 illustrates a plug connector member 100 according to the invention of an electrical plug connector 1 according to the invention as can be seen most clearly in FIGS. 6 and 10. The plug connector member 100 is explained in greater detail below primarily with reference to FIGS. 1 and 10.

The plug connector member 100 comprises at least one electrical pin contact 111 which is preferably constructed as an electrical internal conductor pin contact 111 and which is received in a contact carrier 110 of the plug connector member 100. At a front side 101 of the contact carrier 110 the internal conductor pin contacts 111 protrude outwards from the contact carrier 110 and can be electrically contacted by appropriate electrical internal conductor socket contacts of an electrical counter plug connector (not illustrated in the drawing). At a rear side 102 of the contact carrier 110 the internal conductor pin contacts 111 protrude downwards and can be connected, for example, to a printed circuit board or the like in an electrically conductive manner.

The contact carrier 110 is preferably electrically shielded over the entire extent thereof in a longitudinal direction L of the electrical plug connector 1. For this intended purpose, the contact carrier 110 has, in the front region thereof, an external conductor or shield socket 130 which electrically shields the contact carrier 110 from a central region to beyond the electrical internal conductor pin contacts 111, which protrude in a forward direction, over substantially the entire periphery of the contact carrier 110 (see FIG. 10).

Adjacent to the shield socket 130 at the rear, the contact carrier 110 has an electromagnetic shield 118, which can be electrically contacted with the printed circuit board or the like. Because of the two electromagnetic shields 118, 130, the contact carrier 110 is electrically shielded over substantially the entire length thereof. In the central region of the contact carrier 110, the two electromagnetic shields 118, 130 overlap each other, which can also be seen most clearly in FIG. 10.

Preferably, in the central region, the contact carrier 110 has a mounting projection 120 and a mounting portion 119. According to the invention, the contact carrier 110, the mounting portion 119 and the mounting projection 120 may be connected to each other in a materially integral manner. In other embodiments of the invention, it is possible to construct the mounting portion 119 in a materially integral manner with the mounting projection 120 and to make provision for it to be able to be mounted on the contact carrier 110. Furthermore, it is possible to construct the mounting portion 119 in a materially integral manner with the contact carrier 110 and to provide the mounting projection 120 as a separate component, which can be mounted thereon. In the present embodiment, at least the mounting portion 119 is constructed integrally with the mounting projection 120 and is integrally constructed with the contact carrier 110 or can be provided thereon.

Figure 7:
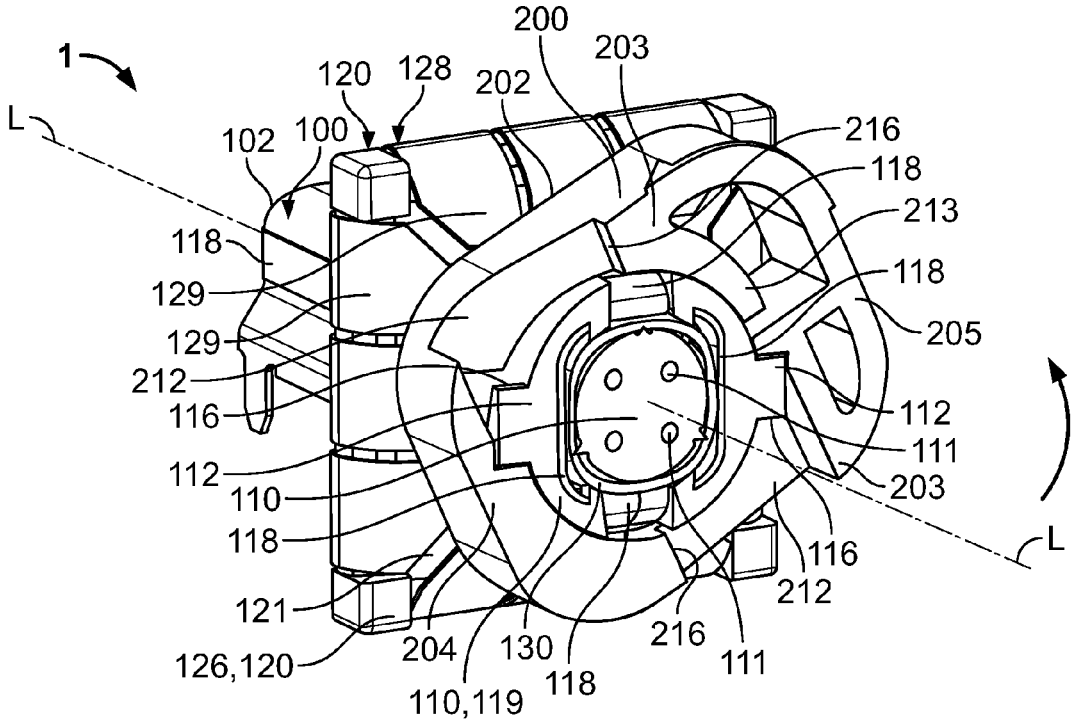
FIG. 7 is a frontally sectioned perspective view of the keyed mounting member in the pre-locking position on the plug connector member.

The electromagnetic shield 118, of a rear portion of the plug connector member 100, extends into the central region of the plug connector member 100 and, with a cut-out flap (see FIGS. 7 and 8), engages around a front region of the mounting portion 119. In this instance, this region is provided on the inner side on the mounting portion 119 which, when viewed from the front side 101, is correspondingly recessed, as can be seen clearly in FIG. 1; the flap can further be clearly seen in FIGS. 7, 8 and 10. The mounting portion 119 and the mounting projection 120 can be secured to the plug connector member 100 by means of the flap.

A portion of the electromagnetic shield 118, provided in the central region of the plug connector member 100, surrounds the shield socket 130 at the rear longitudinal end portion thereof. This can be seen in FIGS. 9 and 10 and in the region of the bent flap in FIGS. 7 and 8. In this region, the shield socket 130, which is constructed in a substantially circular manner in an original cross-section (see FIG. 1), becomes increasingly rectangular as it extends further towards the rear of the plug connector member 100. This may clearly be seen in reference to FIGS. 7, 8, and FIG. 9.

Figure 9:
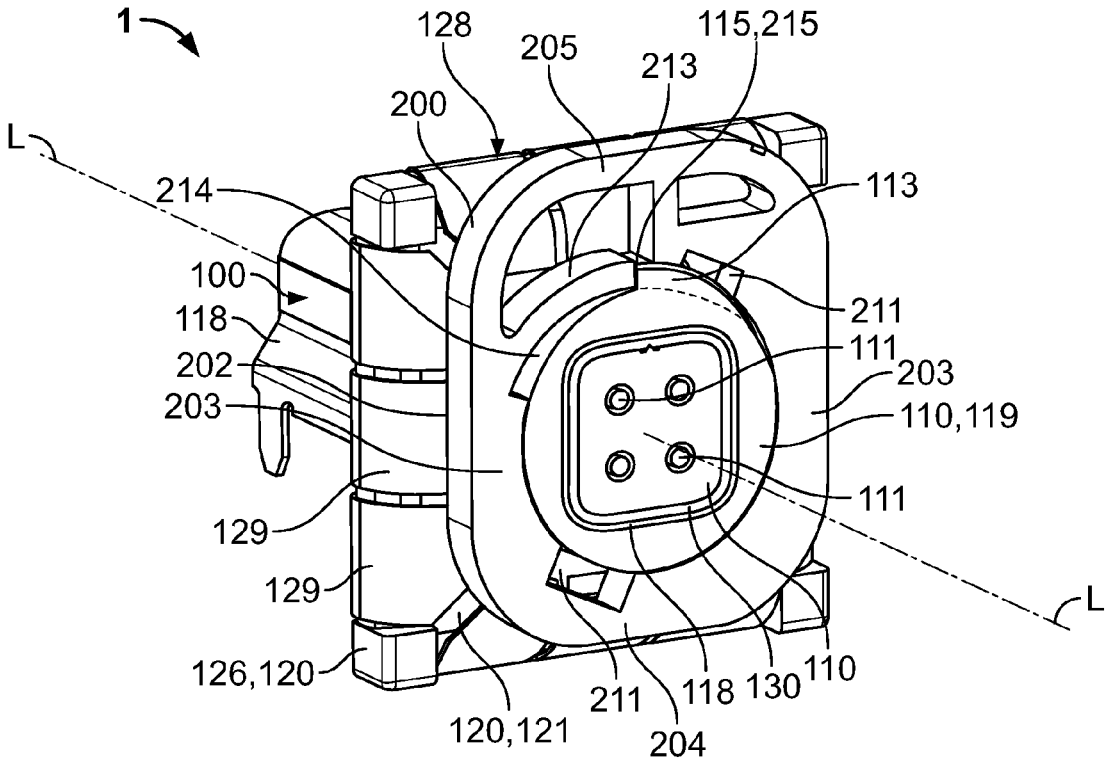
FIG. 9 is a frontally sectioned perspective view of the securing position of the keyed mounting member on the plug connector member.

The close abutment of the shield socket 130 against an inner portion of the contact carrier 110, and a close abutment of the electromagnetic shield 118 against the shield socket 130 can clearly be seen in FIG. 9.

The mounting projection 120 of the contact carrier 110 or the mounting portion 119 or the plug connector member 100 is preferably constructed as a flange that extends around the plug connector member 100. It is preferable that the mounting projection 120, when viewed from the front, is in the form a rectangular, in particular a square shape, as can clearly be seen in FIGS. 7 to 9. Of course, it is possible to select a different shape, in particular a round shape, for the mounting projection 120.

The mounting projection 120 has one or more contact springs 129 on at least at one edge, but preferably at all four edges. These are preferably constructed as electromagnetic shields contact springs 129 and have a flat surface 128 that extends at a rear side of the mounting projection 120 to the electromagnetic shield 118 of the contact carrier 110.

It is thus possible for the flat surface 128 of the shield contact springs 129 to contact the electromagnetic shield 118, 130 of the electrical plug connector 1. When the shield contact springs 129 are preferably constructed integrally with the flat surface 128, it is possible to produce a galvanic contact between the electromagnetic shield 118, 130 of the electrical plug connector 1 and an electromagnetic shield of a housing or a wall 2. This wall 2 is illustrated in FIG. 10 and, preferably at least at the side, which the shield contact springs 129 abut, is constructed of metal or electromagnetically shielded. Preferably, the entire wall 2 is constructed of metal or a metal alloy.

In embodiments of the invention, the mounting projection 120 has, in one or more corner regions, a spacing member 126 by means of which the mounting projection 120 can be fitted to the wall 2. Preferably, in this instance, the electromagnetic shields contact springs 129 may protrude further from a plane of the flange than the relevant spacing members 126 so that the plug connector member 100 can be positioned on the wall 2 with the relevant spacing members 126. At the same time, an electrical pin contact between the shield contact springs 129 and the wall 2 may be achieved. It is also possible to contact the wall 2, from one side, simply with the contact springs 129.

In an embodiment of the invention, the mounting projection 120 is constructed in a planar and square manner, and has a cuboid spacing member 126 in each of the four corner regions. Further, the mounting projection 120 has at each of the edges thereof three shield contact springs 129 between two relevant spacing members 126, wherein the shield contact springs 129 may be connected in a materially integral manner at a rear side to the flat surface 128.

Figure 2:
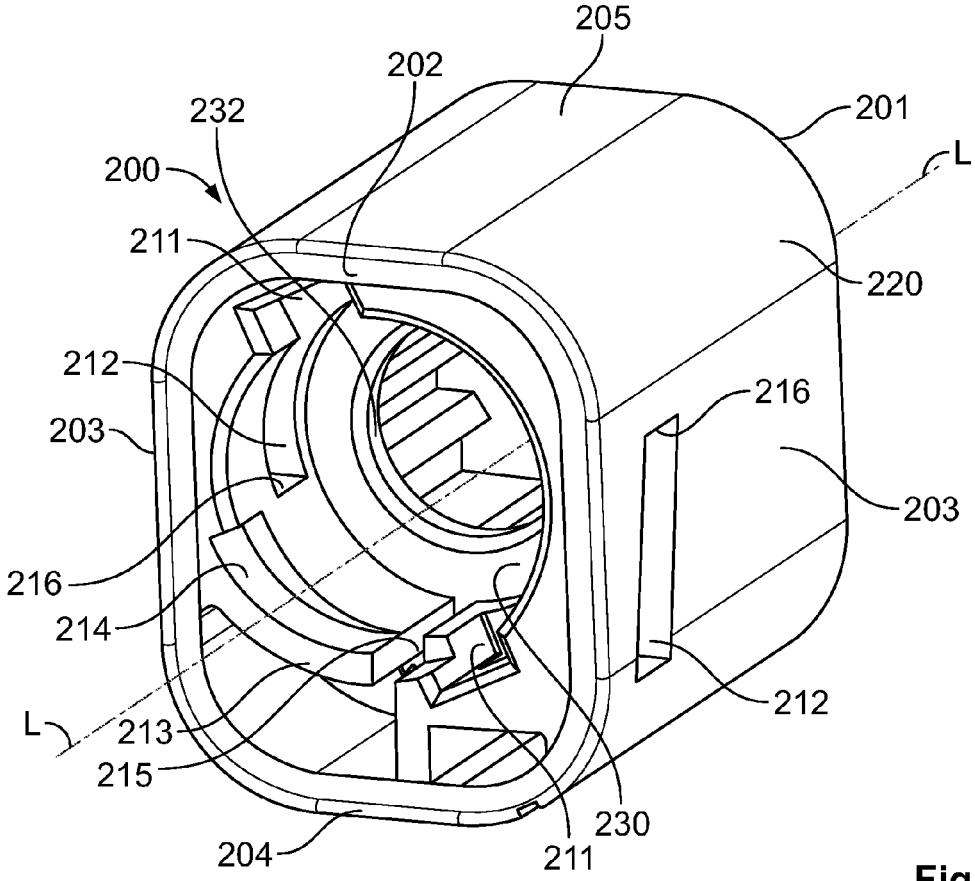
FIG. 2 is a perspective view of a keyed mounting member for the electrical plug connector in accordance with the invention.

In order to mount the plug connector member 100 on the wall 2 with a keyed mounting member 200, as illustrated in FIG. 2, the plug connector member 100 and/or the contact carrier 110 and/or the mounting portion 119 have corresponding equipment or devices which facilitate cooperation with corresponding equipment or devices in/on the keyed mounting member 200. According to the invention, the plug connector member 100 can be securely connected to the keyed mounting member 200 in such a manner that the wall 2 can be clamped between the keyed mounting member 200 and the plug connector member 100, in particular the mounting projection 120 thereof, as can be seen clearly in FIG. 10. In this instance, the spacing members 126 of the mounting projection 120 preferably abut the wall 2 (not illustrated in the drawing).

According to the invention, the keyed mounting member 200 can be mounted or secured on the plug connector member 100. In order to mount or secure the keyed mounting member 200 and the plug connector member 100, a screw connection, plug connection, locking connection or bayonet connection may be used. However, in a preferred embodiment, the keyed mounting member 200 is mounted on the plug connector member 100 by means of a bayonet connection, which mounts or secures the keyed mounting member 200 on the plug connector member 100 by means of a rotational insertion movement.

For the bayonet connection according to the invention, the mounting portion 119 is constructed in a cylindrical manner in a corresponding region and has at least one, preferably two, cam followers 112 which protrude radially from the mounting portion 119, as can be seen in FIGS. 1, 3, 7 and 8. Furthermore, the mounting portion 119 has, further to the rear in the longitudinal direction L than the cam followers 112, a locking ramp 113, which rises from the mounting portion 119 in the peripheral direction of the mounting portion 119, as can be seen clearly in FIGS. 1 and 9. In this instance, the locking ramp 113 continuously rises in a peripheral direction from the cylindrical mounting portion 119. When the mounting portion 119 is viewed from the front, the height of the locking ramp 113 preferably increases in a mathematically positive direction, that is to say, in an anticlockwise peripheral direction on the mounting portion 119.

FIG. 2 illustrates the keyed mounting member 200 according to the invention for the electrical plug connector 1 in accordance with the invention, which allows properly oriented insertion/fitting of the electrical counter plug connector (not illustrated in the drawing) into/on the electrical plug connector 1. The keyed mounting member 200 is explained in greater detail below primarily with reference to FIGS. 2 and 7 to 10.

The keyed mounting member 200 is constructed in a substantially box-like manner and is configured in such a manner that it becomes fastened with the plug connector member 100. For this purpose, the keyed mounting member 200 has locking devices, which correspond to the plug connector member 100 or the mounting portion 119 thereof. In those portions of the plug connector member 100 and the keyed mounting member 200 in which the engagement between them is initiated, the plug connector member 100 and the keyed mounting member 200 are constructed as positive and a negative complementary members.

In a front portion, the keyed mounting member 200 has a keying portion 220 into/on which the electrical counter plug connector can be inserted or fitted. For correct fitting of the counter plug connector, the keying portion 220 and the counter plug connector preferably have mutually corresponding projections and recesses which are, however, not symmetrical with respect to the longitudinal axis L and by means of which incorrect insertion of the counter plug connector can be prevented.

Separated by a partition wall 230, a locking region of the keyed mounting member 200 adjoins the keying portion 220 at the rear. The partition wall 230 has a through-recess 232 so that a front portion of the plug connector member 100 or the shield socket 130 is able to protrude from the rear into the keying portion 220. If the keyed mounting member 200 is secured to the plug connector member 100, a shoulder 117 of the plug connector member 100 or the contact carrier 110 is located directly adjacent to the partition wall 230 or in abutment therewith.

In an inner portion, the locking region of the keyed mounting member 200 has a hollow cylindrical portion which corresponds to the mounting portion 119 of the plug connector member 100 and in which one or two slotted inlets 211 for the cam followers 112 of the plug connector member 100 are provided. That is to say, when the keyed mounting member 200 is fitted on the plug connector member 100, the keyed mounting member 200 is pushed onto the mounting portion 119 so as to be oriented in such a manner (see FIGS. 3 and 4) that the cam followers 112 come to rest in the respective slotted inlet 111.

Furthermore, the keyed mounting member 200 has, on the inner side, adjacent to the respective slotted inlet 211, a cam slot 212 which extends in a peripheral direction and is preferably provided in a relevant side wall 203 of the keyed mounting member 200. In this instance, the cam slot 212 is inclined along the longitudinal direction L of the keyed mounting member 200 in such a manner that, when the keyed mounting member 200 is screwed onto the keyed mounting member 200, the keyed mounting member 200 moves towards the mounting projection 120. Corresponding to the inclination of the slotted path, the relevant cam follower 112 is preferably also inclined, which can be clearly seen in FIGS. 1, 7 and 8.

According to the invention, it is not necessary for the cam slot 212 to be externally visible on the keyed mounting member 200. That is to say, it is not absolutely necessary for it to be constructed as a cam slot 212. It is also possible to provide the cam slot 212 as an internal, preferably partially helical peripheral groove on the locking region of the keyed mounting member 200. However, for visual verification, it is preferable, when the engagement of the keyed mounting member 200 with the plug connector member 100 is produced, for the relevant cam follower 112 to be visible from the outer side on/in the cam slot 212, as can be seen in FIGS. 5 to 8.

According to the invention, the shape of the respective cam slot 212 and the shape of the cam follower 112 should cooperate therewith when the keyed mounting member 200 is secured to the plug connector member 100. In the embodiment of the invention, as further illustrated in the drawings, a cam follower 112 has the substantial form of a parallelogram and is consequently constructed in a substantially prismatic manner. However, the faces in the peripheral direction of the mounting portion may be spherical, that is to say, a portion of a screw face, the cam follower 112 then being a portion of a screw body. In a corresponding manner, the cam slot 212, which is slightly wider in comparison with the cam follower 112, is a straight recess or a portion of a screw body. Alternatively, it is possible to provide the cam follower 112 as a cylindrical projection on the mounting portion 119.

In order to lock the plug connector member 100, the keyed mounting member 200 has a locking element 213, which abuts the locking ramp 113 of the plug connector member 100. In this instance, stops 115, 215 of the locking ramp 113 and the locking element 213 are mutually opposed (see FIG. 9). Furthermore, in this position, the rotary stops 116 (in each case a free end of the cam followers 112 in the peripheral direction) of the cam followers 112 abut corresponding stops 216 which delimit a peripheral extent of a cam slot 212, as can be seen clearly in FIG. 8. Preferably, the locking element 213 is constructed as an inner peripheral portion of the keyed mounting member 200.

Figure 4:
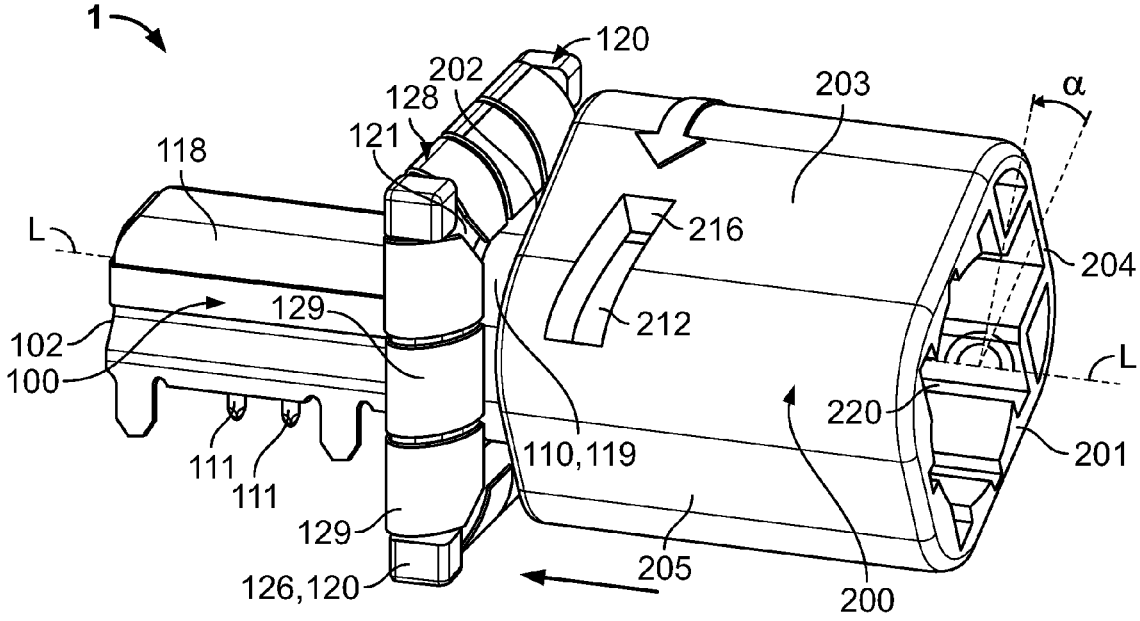
FIG. 4 is a perspective view of the keyed mounting member in a pre-locking position on the plug connector member.
Figure 5:
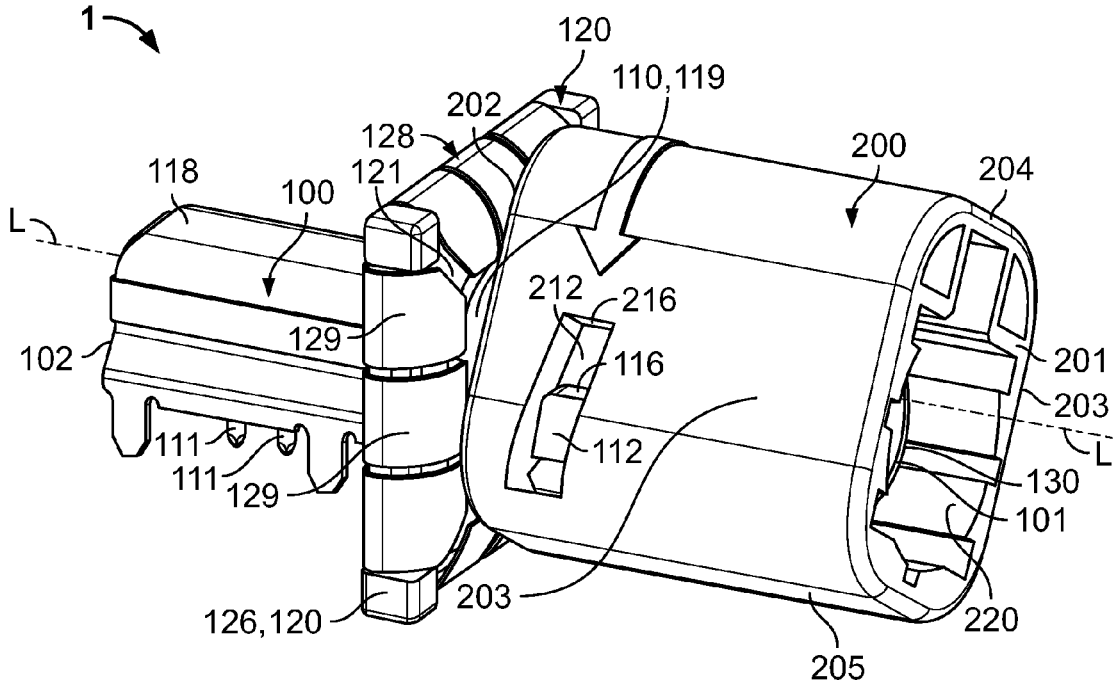
FIG. 5 is a perspective view of the keyed mounting member and the plug connector member being rotated toward a securing position.
Figure 8:
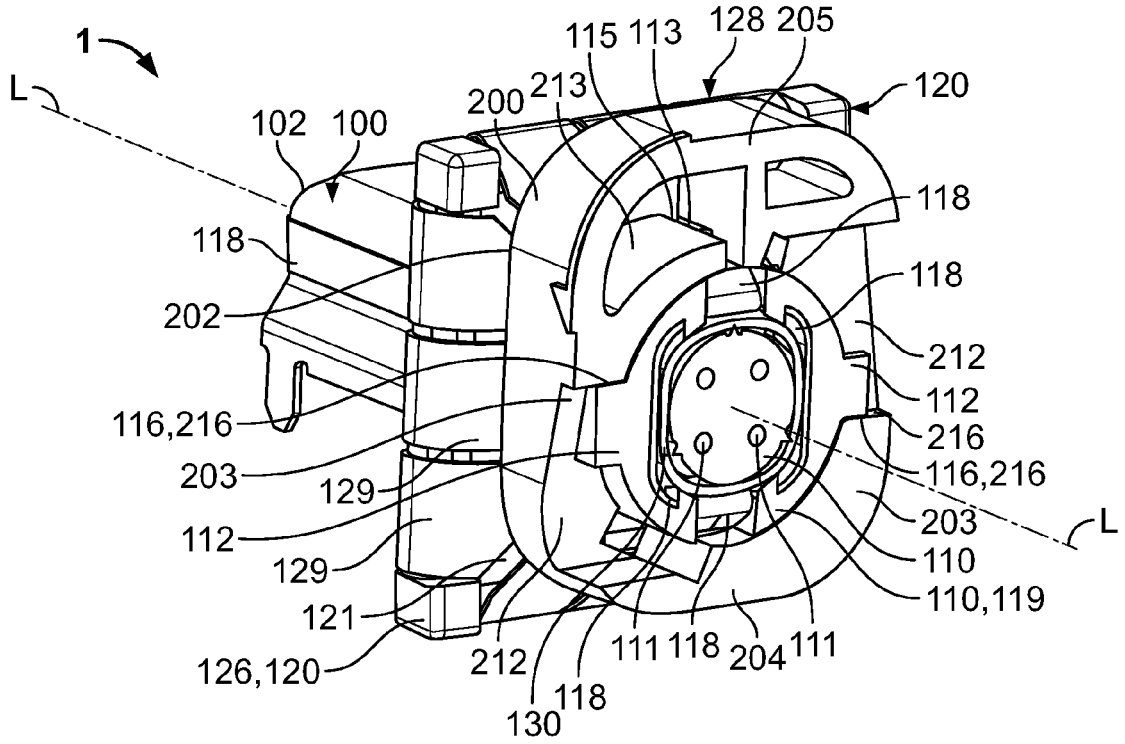
FIG. 8 is a view of the electrical plug connector similar to FIG. 7, but with the keyed mounting member in the securing position on the plug connector member.

In order to bring the locking element 213 into engagement with the locking ramp 113, the locking element 213, on the one hand, is constructed to be wider in the longitudinal direction than the locking ramp 113, as can be seen in FIGS. 2, 8 and 9. On the other hand, the locking element 213 has a recess 214 as can be seen clearly in FIG. 2 and in which the locking ramp 113 can be received in the pre-locking position of the keyed mounting member 200, as illustrated in FIG. 4. In this instance, the recess 214 and the locking ramp 113 are preferably constructed as a positive and a negative, respectively.

The recess 214 preferably extends over substantially the entire peripheral extent of the locking element 213 and is preferably in the form of a spherical wedge. The recess 214—when viewed from a rear end of the locking element 213 (see FIG. 2) is inwardly formed in the locking element 213 along the longitudinal direction L of the keyed mounting member 200, a front-end boundary wall in the locking element 213 delimiting the recess 214. That is to say, the locking element 213 is constructed in a stepped manner in the longitudinal direction L of the keyed mounting member 200, the step becoming increasingly smaller in the direction of a free peripheral end of the locking element 213 and decreasing to zero at the free end. According to the invention, it is possible to provide the locking element 213 with a recess 214, which is shorter in the peripheral direction so that, at a free longitudinal end portion of the locking element 213, there is no longer a step through the recess 214. Furthermore, it is possible to provide the recess 214 at an end opposite the free peripheral end of the locking element 213 to extend into a housing portion of the keyed mounting member 200, as seen in FIG. 2.

When the keyed mounting member 200 is placed on the plug connector member 100 (see FIG. 3), the slotted inlets 211 are pushed over the cam follower 112, the locking ramp 113 being received (not shown in the drawing) in the recess 214 of the locking element 213 in the pre-locking position, as illustrated in FIG. 4.

When the keyed mounting member 200 is rotated (arrow on the keyed mounting member 200) on the plug connector member 100 in the direction of the securing position thereof (see FIG. 6), the locking element 213 is lifted by the locking ramp 113 through the recess 214, which tapers in a peripheral direction (see FIG. 2). When the securing position is achieved, the stop 215 of the locking element 213 passes the locking ramp 113 completely so that the resilient engagement element 213 snaps back in a radial direction and the stop 215 of the keyed mounting member 200 abuts the stop 115 of the locking ramp 113. This is clearly seen in FIG. 9.

Mounting or securing of the keyed mounting member 200 on the plug connector member 100 can be seen in FIGS. 3 to 6. The wall 2, for example of a device housing, has been omitted in these figures. However, this wall 2 can be seen in FIG. 10, which also illustrates the securing position.

When the electrical plug connector 1 is mounted on the wall 2, the plug connector member 100 is first inserted through a mounting hole 300 in the wall 2 and carried forward until the shield contact springs 129 or the mounting projection 120 abut one side of the wall 2. Subsequently, the keyed mounting member 200 moves, from the other side of the wall 2, in the direction towards the plug connector member 100, which can be seen in FIG. 3.

Figure 3:
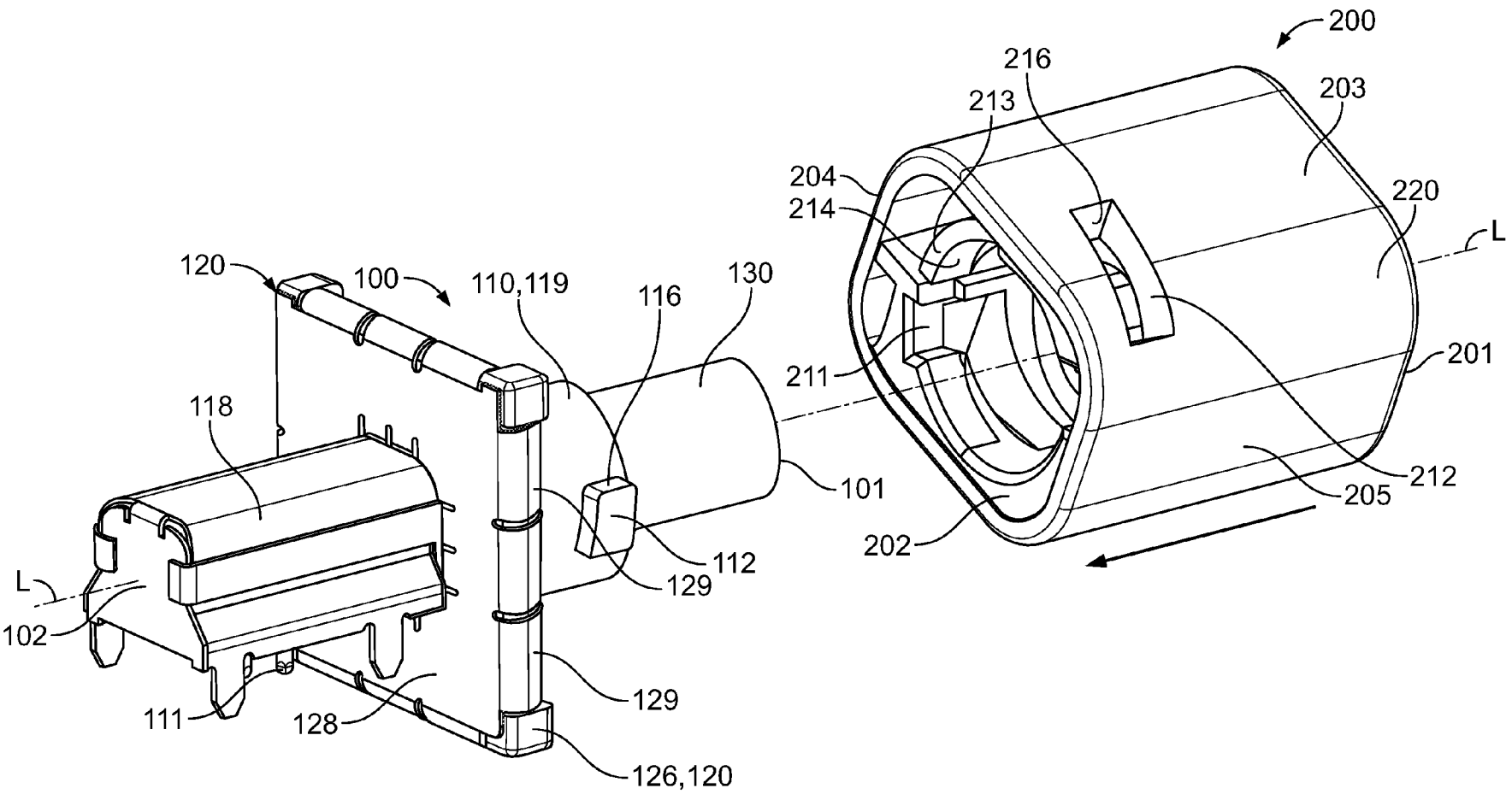
FIG. 3 is a perspective view of the keyed mounting member being inserted onto the plug connector member.

In this instance, the keyed mounting member 200 fits on the plug connector member 100 at a specific angle $\alpha$ (see FIG. 4), which in the present embodiment is approximately 65° (see FIGS. 3 and 4, and as is indicated with an arrow). The angle $\alpha$ designates a fitting angle $\alpha$ of the keyed mounting member 200 on the plug connector member 100 relative to the securing position thereof on the plug connector member 100. Of course, other angles $\alpha$ can be used according to the invention.

Subsequently, the keyed mounting member 200 is rotated relative to the plug connector member 100 (see FIGS. 4 to 6, the arrows on the keyed mounting member 200) until the keyed mounting member 200 locks into a securing position; the keyed mounting member 200 is thus releasably secured to the plug connector member 100. In this position, (see also FIG. 10) the wall 2 is secured between the keyed mounting member 200 and the mounting projection 120 or the spacing members 126 thereof.

Since the slotted paths 212 of the keyed mounting member 200 are inclined relative to the longitudinal direction L, there is both rotational movement and axial movement of the keyed mounting member 200 in a longitudinal direction L towards the mounting projection 120. In addition to the clamping of the wall 2, the electromagnetic shields contact springs 129 are secured in this case, whereby an electrical pin contacting is produced between the electromagnetic shield 118, 130 of the electrical plug connector 1 and the wall 2.

Because of a relative rotational movement of the keyed mounting member 200 with respect to the plug connector member 100, fitting and securing the shield contact springs 129 is significantly simplified with respect to the prior art in terms of the forces and the complexity of mounting the electrical plug connector 1. According to the invention, because of the "bayonet solution", it is possible to dispense with an additional lock nut which allows an additional assembly step and component to be omitted compared with the prior art.

The invention is suitable in particular in the field of automotive electronics for high-frequency signal transmission. However, the invention can be used in any situation where an electrical plug connector 1 can be mounted on a wall 2.

The invention claimed is:

1. An electrical plug connector for a data transmission interface in a motor vehicle, comprising:

a plug connector member and a keyed mounting member which can be mounted on the plug connector member and which ensures correctly oriented insertion of an electrical counter plug connector on the electrical plug connector, the plug connector member comprising a contact carrier having a locking ramp and a mounting projection such that a wall can be clamped between the mounting projection and the keyed mounting member;

the keyed mounting member comprising a locking element having a recess which receives the locking ramp when the keyed mounting member is mounted on the contact carrier;

the locking element being movable by the locking ramp during relative rotation of the keyed mounting member, to a locked and securing position on the contact carrier.

2. An electrical plug connector according to claim 1, wherein a rear side of the keyed mounting member and a front side of the mounting projection are substantially mutually parallel when the keyed mounting member is mounted on the plug connector member.

3. An electrical plug connector according to claim 1, wherein the keyed mounting member is mounted on the plug connector member by means of a threaded connection or a locking connection, and a locking connection is configured as a bayonet connection.

4. An electrical plug connector according to claim 1, wherein the keyed mounting member has, at a rear side thereof, a slotted inlet into which a cam follower of the contact carrier can be introduced when the keyed mounting member is mounted on the contact carrier of the electrical plug connector.

5. An electrical plug connector according to claim 4, wherein the keyed mounting member has, in a side wall, a cam slot in which the cam follower of the contact carrier can be guided in a relative rotation of the keyed mounting member with respect to the contact carrier.

6. An electrical plug connector according to claim 5, wherein the cam slot of the side wall is arranged in an inclined manner along a longitudinal axis of the electrical plug connector, in particular with respect to a longitudinal axis of the keyed mounting member.

7. An electrical plug connector according to claim 1, wherein the locking element is constructed as a locking spring and which abuts the locking ramp of the contact carrier when a keyed mounting member is secured on the plug connector member.

8. An electrical plug connector according to claim 1, wherein the locking ramp of the contact carrier, together with the recess of the locking element, moves the locking element over the locking ramp during relative rotation of the keyed mounting member with respect to the contact carrier, and the locking element springs back behind and engages the locking ramp when the keyed mounting member reaches a securing position on the contact carrier.

9. An electrical plug connector according to claim 1, wherein the mounting projection has, at a front side thereof, a contact spring which abuts the wall when the electrical plug connector is in a state mounted on the wall, and the contact spring is constructed as a shield contact spring which is electrically connectable with an electromagnetic shield of the electrical plug connector.

10. An electrical plug connector according to claim 1, wherein the mounting projection has, at a front side thereof, a spacing member by means of which the mounting projection abuts the wall when the electrical plug connector mounts in an opening of the wall.

11. An electrical pin contact strip for a data transmission interface in the automotive field, comprising:

at least one electrical pin contact;

an electrical plug connector having a keyed mounting member which can be mounted on a plug connector member and which ensures correctly oriented insertion of an electrical counter plug connector on the electrical plug connector, the plug connector member having a mounting projection such that a wall can be clamped between a mounting projection and the keyed mounting member, and wherein the mounting projection has, at the front side thereof, a contact spring which abuts the wall when the electrical plug connector is in a state mounted on the wall, and the contact spring is constructed as a shield contact spring which is electrically connectable with an electromagnetic shield of the electrical plug connector.

* * * * *